US005470067A

United States Patent [19]

Diresta

[11] Patent Number: 5,470,067

[45] Date of Patent: Nov. 28, 1995

[54] DETACHABLE PUCK DISPENSING APPARATUS AND METHOD FOR HOCKEY STICK

[75] Inventor: James D. Diresta, Woodmere, N.Y.

[73] Assignee: Rapid Mounting & Finishing Co, Chicago, Ill.

[21] Appl. No.: 379,170

[22] Filed: Jan. 27, 1995

[51] Int. Cl.[6] ..... A63B 71/02

[52] U.S. Cl. ..... 273/57.2; 273/194 R

[58] Field of Search ..... 273/26 B, 29 A, 273/57.2, 32 D, 67 A, 35 R, 194 R, 194 A, 199 R, 201, 129 R, 129 K, 129 L; 124/41.1, 42, 43, 46, 47

[56] References Cited

U.S. PATENT DOCUMENTS

| | | | |
|---|---|---|---|
| 3,111,314 | 11/1963 | Topper | 273/26 B |
| 3,236,521 | 2/1966 | Knott | 273/26 B |
| 3,665,910 | 5/1972 | Boni . | |
| 3,794,318 | 2/1974 | Holmes . | |
| 3,876,201 | 4/1975 | King | 273/57.2 |
| 4,607,842 | 8/1986 | Daoust | 273/57.2 |
| 4,850,483 | 7/1989 | Stack | 273/32 D |
| 4,875,579 | 10/1989 | Tak | 273/32 D |
| 5,024,435 | 6/1991 | Robbins | 273/26 B |
| 5,069,451 | 12/1991 | Martens et al. | 273/57.2 |
| 5,396,876 | 3/1995 | Liscio et al. | 273/57.2 |

*Primary Examiner*—Vincent Millin
*Assistant Examiner*—William M. Pierce
*Attorney, Agent, or Firm*—Willian Brinks Hofer Gilson & Lione

[57] ABSTRACT

A sports practice device including a dispenser having a chamber for retaining at least one projectile. The chamber has a base for supporting the at least one projectile and an aperture for ejecting the at least one projectile. A mounting is attached to the dispenser, which detachably couples the dispenser to a shaft of a player held projectile propelling device. According to a preferred embodiment, the player held projectile propelling device can be a hockey stick and the projectile can be a puck or ball. A method of attaching a projectile dispenser to a player held projectile propelling device, inserting at least one projectile into the dispenser, releasing a projectile from the projectile dispenser, and impacting the projectile, is also provided.

29 Claims, 3 Drawing Sheets

DETACHABLE PUCK DISPENSING APPARATUS AND METHOD FOR HOCKEY STICK

BACKGROUND OF THE INVENTION

The present invention relates generally to a device for developing or improving skills of players involved in projectile propelling sports or activities and, more particularly, to a device for use when practicing an activity or game, such as ice hockey, field hockey, street hockey, lacrosse, or polo, where propelling projectiles at a goal or target is an objective.

A player has to practice in order to maintain or improve his skills in sporting activities. One sports skill that is often practiced is shooting projectiles at a goal or target with a stick or mallet. For example, players typically line up at a certain distance (e.g., the blue line in ice hockey) from the goal and propel projectiles (e.g., pucks or balls) at the goal. Additionally, in some games, drills can be performed where a player tries to score one-on-one against a goalie. Traditionally, however, once a player has released the projectile at the goal or target, the player has to retrieve the projectile or obtain another projectile before shooting again.

Hockey devices have been developed to propel a puck along the playing surface in order to enhance hockey practices. Such devices are traditionally filled with pucks and placed at a stationary position on the playing surface. The pucks may be propelled from these hockey devices when the player or another person turns a handle or crank, or the pucks may be propelled by an electro-mechanical device. However, when using these devices, if the player desires to receive the puck at another position on the playing surface, the player is usually required to move or re-position the device. Thus, conventional devices may not permit a player to shoot from a desired location on the playing surface, and then quickly move to another desired location, dispense another projectile, and shoot again. Further, these devices are not readily portable from practice to practice by an individual player.

Accordingly, there is a need for a device and method allowing a player to quickly dispense projectiles at various desired locations on the playing surface. It would also be beneficial if such a device is light weight and can be fastened to the stick or club so the player could dispense the projectiles rapidly and without removing his or her hands from the stick or club.

SUMMARY OF THE INVENTION

In view of the above, the present invention relates to a device for use in developing or improving skills of players involved in projectile propelling activities. The device is capable of storing a plurality of projectiles and conveniently dispensing the stored projectiles at desired locations about a playing surface (e.g., ice rink, field or pavement). The device allows the player to shoot a dispensed projectile at a target or goal from a variety of positions on the playing surface. Accordingly, a player can make a shot and quickly be ready for the next shot without chasing down the projectile to a new position or retrieving the projectile. The device is preferably portable, lightweight, inexpensive, easily attachable to a shaft of a stick, and adapted to store and release one or more balls, pucks or other projectiles. Further, the device can preferably be utilized by both right-handed or left-handed players.

In one aspect of the invention, the device includes a dispenser having a chamber for retaining at least one projectile. The chamber includes a base for supporting the at least one projectile and an aperture for ejecting the at least one projectile. A mounting is attached to the dispenser and is adapted to be detachably coupled to a shaft of a player held projectile propelling device.

According to another aspect of the invention, a method of utilizing the dispenser is provided. The method includes the steps of attaching a projectile dispenser to a player held projectile propelling device, inserting at least one projectile into the dispenser, releasing a projectile from the dispenser, and impacting the first projectile with the player held projectile propelling device. Preferably, the dispenser holds and repetitively dispenses a plurality of projectiles.

These and other features and advantages of the invention will become apparent upon a review of the following detailed description of the presently preferred embodiments of the invention, taken in conjunction with the appended drawings.

DETAILED DESCRIPTION OF THE PRESENTLY PREFERRED EMBODIMENTS

Figure 1:
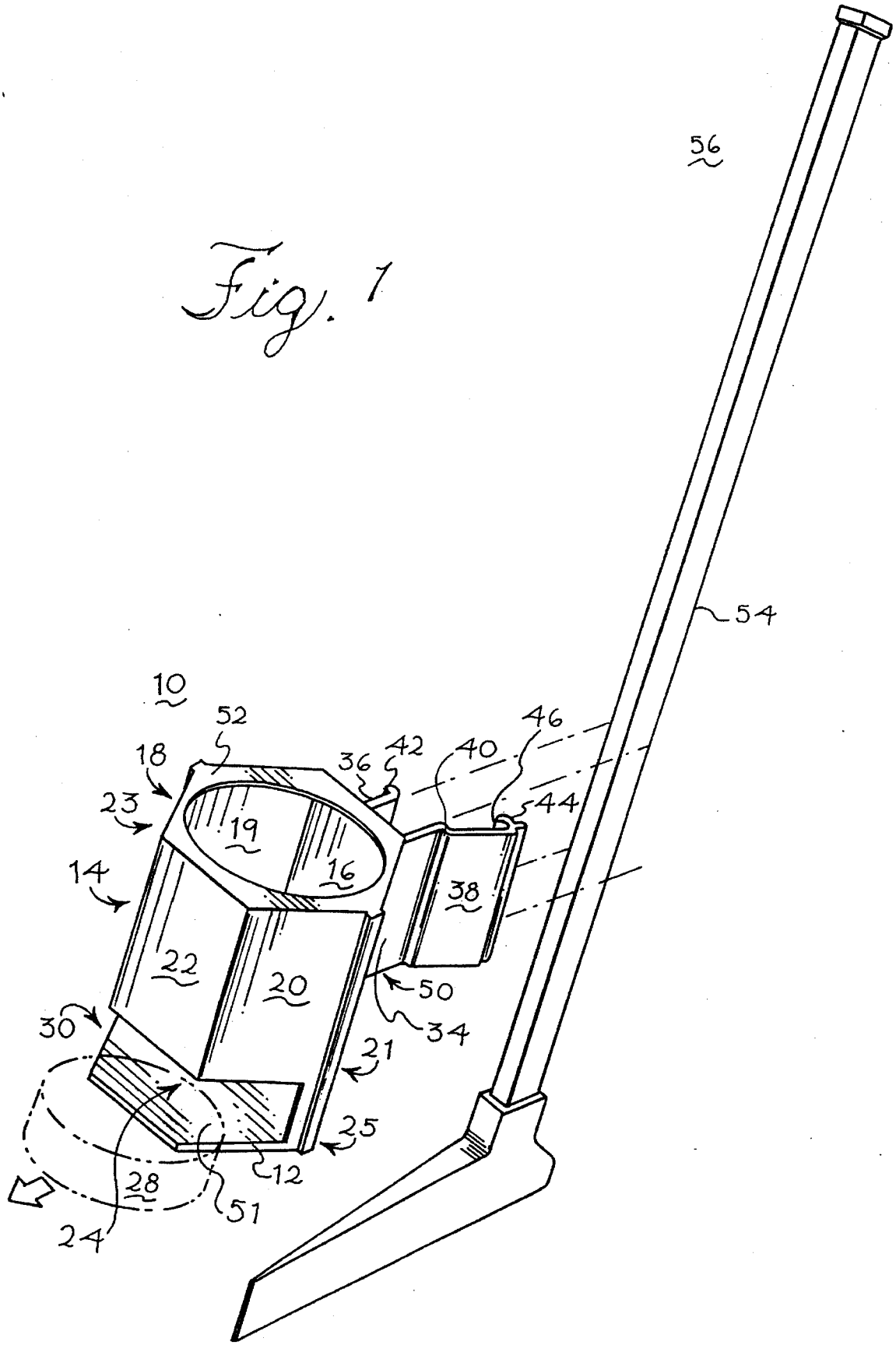
FIG. 1 is a perspective view of one preferred embodiment of a projectile dispenser attached to a shaft of a hockey stick.

Referring now to the drawings in detail, and more particularly to FIG. 1, a presently preferred embodiment of the invention is illustrated. A dispenser 10 is shown for attachment to a shaft 54 of a hockey stick 56. The dispenser 10 is preferably manufactured from a hard plastic material. In one preferred embodiment of the invention, the dispenser 10 is constructed from high impact poly-styrene. As those skilled in art recognize, the dispenser 10 may also be made from a variety of materials including other plastics (e.g. polypropylene), as well as aluminum, fiberglass, or after rigid or semi-rigid material without departing from the spirit and scope of the invention.

Figure 2:
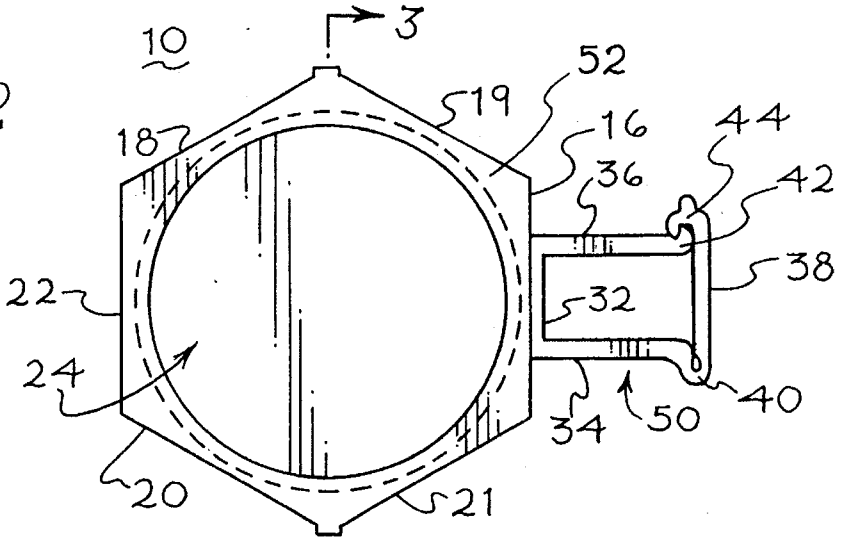
FIG. 2 is a top view of the projectile dispenser of FIG. 1.

In a preferred embodiment, the dispenser 10 generally comprises a housing 14, a base 12, a top 52, a cheer 24, and an attachment element 50. The housing 14 is preferably hexagonal-shaped with six substantially equal sides and angles as shown in FIG. 2. The housing 14 includes a back wall 16, front side walls 18 and 20, back side walls 19 and 21, and a front wall 22. The back wall 16, side walls 18, 19, 20, and 21, and the front wall 22 are generally of a planar, rectangular configuration. As those skilled in the art will appreciate, the size and shape of the housing 14 may be modified to accommodate the shape of any projectile without departing from the spirit and scope of the invention. For example, the housing 14 may be cylindrically shaped.

Figure 3:
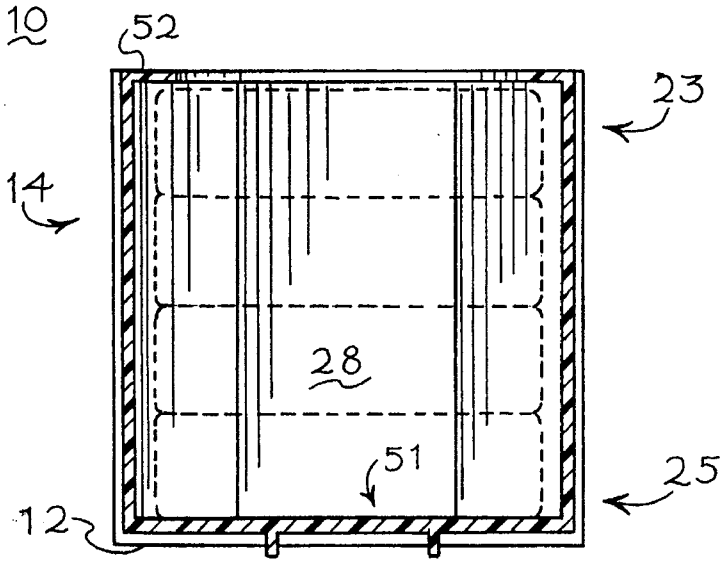
FIG. 3 is a cross-sectional view of the projectile dispenser taken about line 3—3 of FIG. 2.

In addition, the housing 14 preferably has an upper end 23 and a lower end 25. A top 52 is attached or secured to the upper end 23 of the housing 14. The top 52 preferably comprises a retaining ring or the like to retain the projectiles 28 (shown in phantom) within the dispenser (see FIGS. 3 and 4). The top 52 may also have an opening so that a player may observe the projectiles 28 within the dispenser 10 to determine when and if the dispenser becomes empty of projectiles. According to some alternately preferred embodiments, the top 52 may be detachable or pivotally secured (not shown) to the upper end 23 of the housing 14 and used for inserting projectiles 28 into the dispenser 10.

Figure 4:
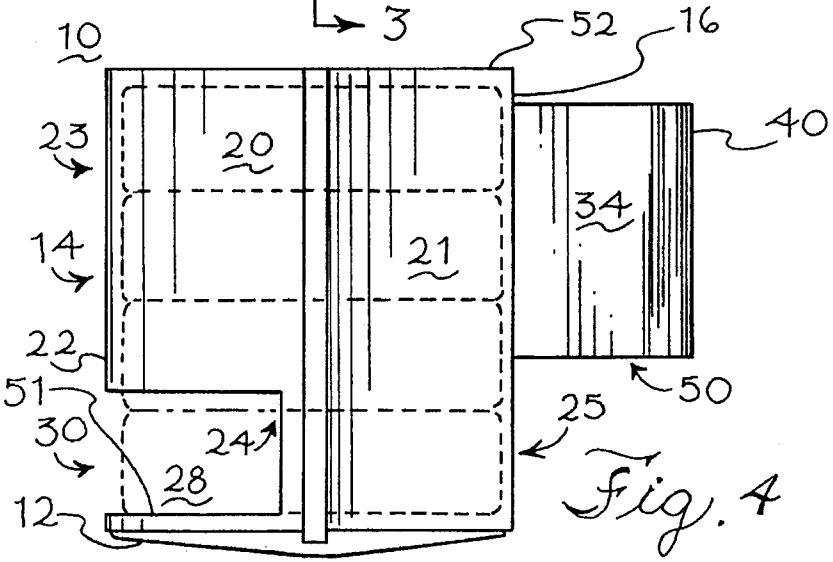
FIG. 4 is a side view of the projectile dispenser of FIG. 1.

The base 12 is attached or secured to the lower end 25 of the housing 14. The base 12 includes a surface 51 for supporting the projectiles 28 within the chamber 24. The surface 51 supports the bottom projectile 28 within the housing 14 and aligns the bottom projectile 28 with an aperture 30 for player controlled release (FIG. 4).

The chamber 24 is defined by the inner surfaces of the back wall 16, the side walls 18, 19, 20 and 21, the base 12, the top 52, and the front wall 22. The chamber 24 is preferably hexagonal-shaped. However, variations are available for the shape of the chamber 24 to accommodate various projectiles without departing from the spirit and scope of the invention. For example, the chamber 24 may be cylindrically shaped.

The chamber 24 also includes the aperture 30. The aperture 30 is preferably formed in the shape of a slot, and is of sufficient size to permit projectiles 28 (e.g., pucks) to pass through the aperture 30. The aperture 30 is preferably disposed in the front wall 22 and front side walls 18 and 20 substantially near the base 12 of the chamber 24. As those skilled in the art will appreciate, the aperture 30 may be disposed at different positions in the chamber 24 without departing from the scope of the invention.

The aperture 30 provides for player controlled release or ejection of a projectile 28 from the chamber 24 as desired by the player. A player thus dispenses the projectile 28 through the aperture 30 onto the playing surface by an upwardly urging movement of the stick or club 56 to which the dispenser 10 is mounted. This action causes the lowest projectile in the chamber 24 to be released while the dispenser 10 holds the remainder of the projectiles, if any, in the chamber 24. After the previous projectile has been released, gravity will cause the remaining projectiles within the chamber 24 to move downwardly in the chamber 24 so that the next in line projectile may be dispensed when the player again urges his stick upwardly to release a projectile. Accordingly, a player can dispense and shoot a single projectile, or repetitively dispense and shoot as many projectiles as the dispenser 10 will hold.

The dispenser 10 may be attached to a shaft 54 of a stick 56 (e.g., a hockey stick) by an attachment element or mounting 50. In one preferred embodiment, the attachment element 50 comprises a collar or sleeve including a front member 38, a back member 32, and a pair of side members 34 and 36. As those skilled in the art will appreciate, the dispenser 10 may also be attached or mounted to the stick 56 by other means, such as a clamp, coupling, or the like. Furthermore, the stick 56 and dispenser 10 could be manufactured as a single unit by conventional techniques known in the art without departing from the spirit and scope of the invention.

The back member 32 of the attachment element 50 is generally of a rectangular configuration and is attached at one of its surfaces to the back wall 16 of the housing 14. Frictional foam spacers (not shown) may be mounted on the opposite surface of the back member 32 to help prevent the attachment element 50, and as a result the dispenser 10, from sliding or moving along the shaft 54 of the stick 56.

The side members 34 and 36 preferably extend substantially perpendicular to the back member 32. Side member 36 further includes an outwardly extending ridge 42 which runs parallel to its outer edge.

The front member 38 is pivotally attached, preferably by a living hinge 40, at one of its ends to the side member 34. A flange 44 extends substantially perpendicularly to the front member 38 on the opposite end from the hinge 40. The flange 44 has a groove 46 formed therein for engaging and securing the flange 44 to the ridge 42 of the side member 36.

Figures 5, 6:
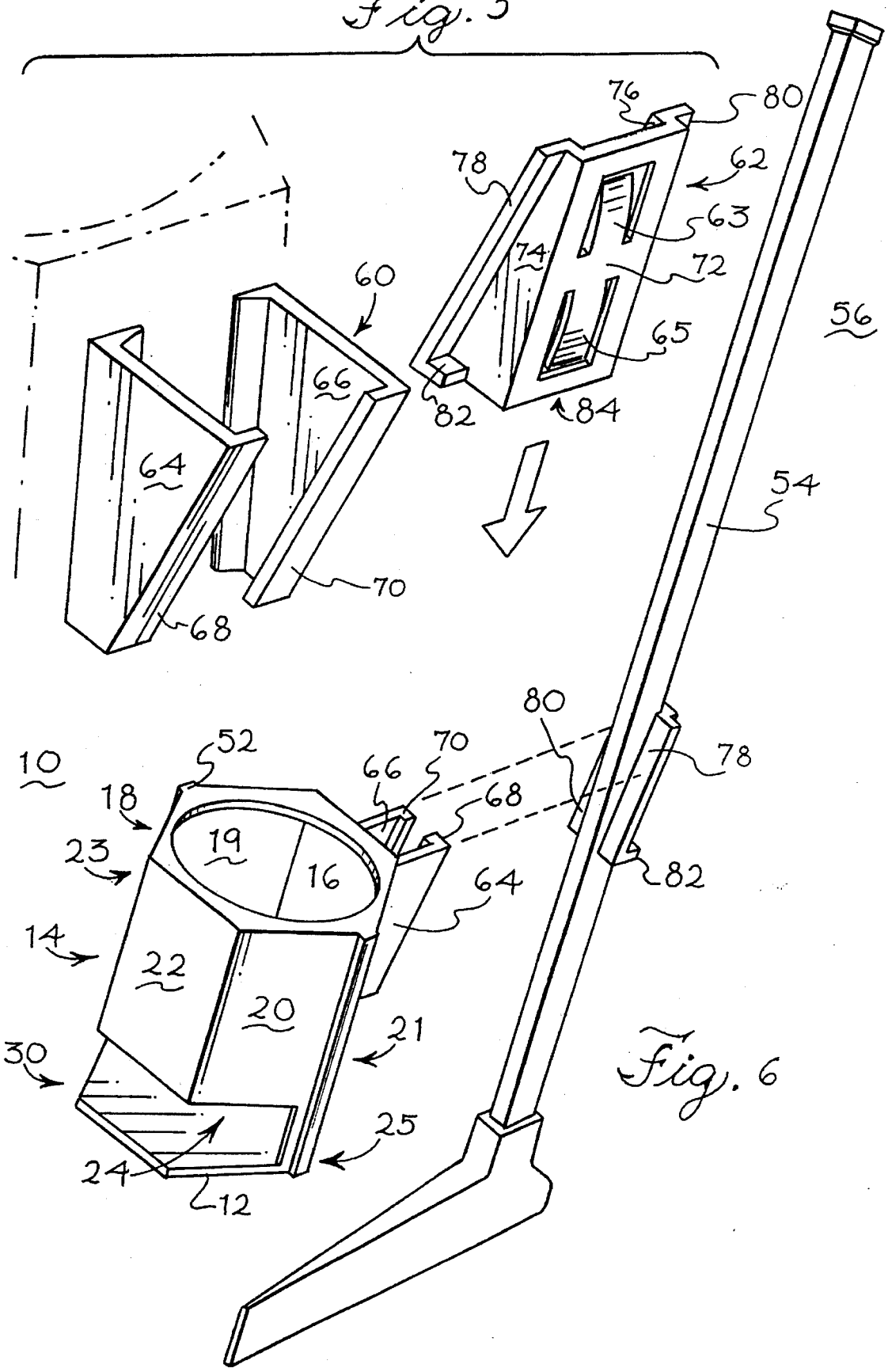
FIG. 5 is a perspective view of one preferred embodiment of the attachment element of the projectile dispenser.
FIG. 6 is a perspective view of the projectile dispenser employing the attachment element of FIG. 5 and coupled to a shaft of a hockey stick.

Referring now to FIGS. 5 and 6, one alternate preferred embodiment of the attachment element 50 is shown. In this embodiment, the attachment element 50 preferably includes a first member 60 and a second member 62. The first member 60 preferably has two substantially parallel side walls 64 and 66 that are attached or coupled to the back wall 16 of the housing 14 (shown in phantom). The side walls 64 and 68 are generally of a V-shaped configuration for attachment to the second member 62. The side walls 64 and 66 have tracks 68 and 70 that extend substantially perpendicular therefrom to enable such attachment.

The second member 62 preferably includes a front bracket 72, side brackets 74 and 76, and tracks 78 and 80. The front bracket 72 is generally of a rectangular configuration. The front bracket 72 has a pair of flanges 63 and 65 that extend inwardly from the front bracket 72 to abut or contact the shaft 54. The flanges 63 and 65 help prevent the attachment element 50 from sliding or moving along the shaft 54 of the stick 56.

The side brackets 74 and 78 extend substantially perpendicular to the front bracket 72. The side brackets 74 and 76 are generally of a V-shaped configuration. The side brackets 74 and 76 have tracks 78 and 80 that extend therefrom that align and mate with the tracks 68, 70 of the first member 60. The tracks 78 and 80 of the second member 62 preferably have ribs 82 and 84 attached thereto to secure the second member to the first member 60. The ribs 82 and 84 of the second member 62 preferably snap or slide over the lower edges of tracks 68 and 70 of the first member 60 and lock the first and second members 60, 62 in fixed alignment. Such an arrangement is generally known in the art as a living wedge.

The dispenser 10 may be attached to a shaft 54 of a stick 56 and loaded with a plurality of projectiles 28 through the aperture 30. Preferably, the dispenser 10 can hold up to four hockey pucks or three street hockey balls. The pucks or balls may be stacked vertically within the chamber 24. After loading the dispenser 10 with as many projectiles 28 as desired or as the device will hold, a player may conveniently dispense the loaded projectiles 28 one at a time onto the playing surface. To dispense a projectile 28, the player preferably urges the stick 56 in an upward motion to release the projectile 28 through the aperture 30. When a projectile 28 is dispensed, the player may impact and propel it quickly and accurately by shooting the projectile 28 at a target or goal.

The dispenser 10 is preferably adapted for use with any player held projectile propelling device. Examples of such devices include ice hockey sticks, field hockey sticks, lacrosse sticks and polo mallets, to name a few. Such devices are held and/or wielded by the player and readily carried by the player about the playing surface during play of the game. Moreover, each such device also includes a surface, either rigid or flexible, for impacting or directing a projectile 28 in a chosen direction. Surfaces suitable for impacting or propelling projectiles 28 can include blades, mallets heads or even nets.

According to the invention, the dispenser 10 allows the player to conveniently practice shooting projectiles 28 from a variety of positions on the playing surface. In this manner, a player can make a shot and quickly be ready for the next shot without chasing down the projectile 28 or waiting for its return. Thus, the player can quickly take a plurality of shots at the target or goal from different positions on the playing surface. In addition, the player may also concentrate on practicing a certain type of shot repetitively until mastered.

Although the present invention has been described in detail by way of illustration and example, various changes and modifications may be made without departing in any way from the spirit of the invention and scope of the appended claims.

I claim:

1. A sports practice device for use with a player held projectile propelling device and at least one projectile, comprising:

a dispenser having a chamber means for retaining the at least one projectile, the chamber means having a base for supporting the at least one projectile and an aperture for ejecting the at least one projectile; and a mounting means attached to the dispenser, the mounting means adapted to be detachably coupled to the player held projectile propelling device.

2. A sports practice device as recited in claim 1, wherein the dispenser is substantially cylindrically shaped.

3. A sports practice device as recited in claim 1, wherein the aperture is disposed near the base of the dispenser.

4. A sports practice device as recited in claim 1, wherein the at least one projectile comprises a puck.

5. A sports practice device as recited in claim 1, wherein the at least one projectile comprises a ball.

6. A sports practice device as recited in claim 1, wherein the player held projectile propelling device comprises a hockey stick.

7. A sports practice device as recited in claim 1, wherein the mounting comprises a collar.

8. A sports practice device as recited in claim 1, wherein the mounting comprises a sleeve.

9. A sports practice device as recited in claim 1, wherein the mounting means comprises a living wedge.

10. A projectile dispenser as recited in claim 9, wherein the at least one projectile comprises a puck.

11. A projectile dispenser coupled to a player held projectile propelling device, comprising:

means for retaining a plurality of projectiles;

means for dispensing at least one projectile upon movement of the projectile propelling device by the player; and means for detachably coupling the dispenser to the projectile propelling device.

12. A projectile dispenser as recited in claim 11, wherein the means for retaining comprises a substantially cylindrical chamber.

13. A projectile dispenser as recited in claim 12, wherein the chamber comprises an aperture and a base.

14. A projectile dispenser as recited in claim 13, wherein the aperture is disposed substantially near the base.

15. A projectile dispenser as recited in claim 11, wherein the means for dispensing comprises an aperture.

16. A projectile dispenser as recited in claim 11, wherein the means for coupling comprises a mounting.

17. A projectile dispenser as recited in claim 16, wherein the mounting comprises a collar.

18. A projectile dispenser as recited in claim 16, wherein the mounting comprises a sleeve.

19. A projectile dispenser as recited in claim 16, wherein the mounting comprises a living wedge.

20. A projectile dispenser coupled to a player held projectile impacting device, comprising:

a housing defining a chamber adapted to hold a plurality of projectiles, the housing having an upper end and a lower end and having an aperture disposed substantially near the lower end for releasing projectiles from the housing upon an urging movement of the projectile impacting device by the player;

a projectile retainer coupled at the upper end of the housing;

a projectile supporting base coupled at the lower end of the housing; and a mounting attached to the housing, the mounting adapted to detachably couple the housing to the projectile impacting device.

21. A projectile dispenser as recited in claim 20, wherein the housing is substantially cylindrically shaped.

22. A projectile dispenser as recited in claim 20, wherein the player held projectile impacting device comprises a hockey stick.

23. A projectile dispenser as recited in claim 20 wherein the mounting comprises a collar.

24. A projectile dispenser as recited in claim 20 wherein the mounting comprises a sleeve.

25. A projectile dispenser as recited in claim 20 wherein the mounting comprises a living wedge.

26. A hockey practice device comprising:

a hockey stick having a shaft;

a dispenser attached to the shaft of the hockey stick, the dispenser having a chamber for holding a plurality of projectiles and having an aperture for dispensing the projectiles; and a coupler detachably fastening the dispenser to the shaft of the hockey stick.

27. A method of dispensing a projectile comprising the steps of:

providing a projectile dispenser;

attaching the projectile dispenser to a shaft of a player held projectile propelling device;

inserting at least one projectile into the dispenser;

releasing a projectile from the projectile dispenser; and impacting the projectile with the projectile propelling device.

28. The method of claim 27, wherein the projectile propelling device comprises a hockey stick, the hockey stick having a shaft.

29. The method of claim 27, further comprising the step of repetitively releasing projectiles from the projectile dispenser and impacting the projectiles in a chosen direction.

* * * * *